United States Patent [19]

Moore

[11] Patent Number: 4,627,490

[45] Date of Patent: Dec. 9, 1986

[54] WELL BORE BARRIER PENETRATOR ARRANGEMENT AND METHOD FOR MULTIPLE CONDUCTOR PUMP POWER CABLE

[76] Inventor: Boyd B. Moore, 427 Mignon, Houston, Tex. 77024

[21] Appl. No.: 691,558

[22] Filed: Jan. 15, 1985

[51] Int. Cl.[4] ..... E21B 33/10; E21B 17/043

[52] U.S. Cl. ..... 166/65.1; 166/88; 166/106

[58] Field of Search ..... 166/65.1, 75.1, 77, 166/313, 382, 385, 387, 242, 106, 147; 339/94 R, 94 A, 94 M; 174/77 R, 68 R

[56] References Cited

U.S. PATENT DOCUMENTS

| | | | |
|---|---|---|---|
| 3,437,149 | 4/1969 | Cugini et al. | 166/88 |
| 3,800,870 | 4/1974 | Pitts, Jr. | 166/106 X |
| 4,154,302 | 5/1979 | Cugini | 166/65.1 X |

*Primary Examiner*—Stephen J. Novosad

*Assistant Examiner*—Thuy M. Bui

*Attorney, Agent, or Firm*—Jack W. Hayden

[57] ABSTRACT

A well bore barrier penetrator arrangement and method for a multiple conductor pump power cable includes a clamp for clamping each steel tube encased conductor and a seal arrangement for each conductor supported in a housing to enable each conductor to pass through the barrier and extend therebeyond on each side of the barrier. A member is movable longitudinally of the housing to secure the clamp arrangement and conductors against movement longitudinally relative to the housing and to compress the seal into sealing engagement with each of the conductors. The multiple conductors with the steel tubes thereon terminate at different longitudinal positions on each side of the barrier and coupling means engage each of the conductors on each side of the barrier with a power cable for supplying power to a pump connected to a production tubing in the well bore.

15 Claims, 5 Drawing Figures

WELL BORE BARRIER PENETRATOR ARRANGEMENT AND METHOD FOR MULTIPLE CONDUCTOR PUMP POWER CABLE

CROSS REFERENCES TO RELATED APPLICATIONS

The present invention relates to my copending application Ser. No. 691,550 filed on Jan. 15, 1985 for WELL BORE ELECTRIC PUMP POWER CABLE CONNECTOR FOR MULTIPLE INDIVIDUAL, INSULATED CONDUCTORS OF A PUMP POWER CABLE and to application Ser. No. 691,550 filed on Jan. 15, 1985 for WELL BORE PUMP POWER CABLE SPLICE ARRANGEMENT.

BRIEF DESCRIPTION OF THE INVENTION

1. Field of the Invention

The present invention relates to a method and apparatus for successfully passing multiple conductors of a power cable through a well bore barrier such as a wellhead apparatus, downhole packer or the like and maintaining them in operation under well bore pressure differentials. Heretofore, substantial difficulty has been encountered in arrangements for conducting a multiple conductor power cable through a barrier such as a wellhead, production packer and the like associated in a wellbore. The arrangements presently employed are complicated in that they are difficult to install in the field, generally incapable of operating under the tremendous electrical load conditions to which they are subjected, and the installations presently employed may require repair or replacement as they are subject to being incapable of operating over a desirable period of time under the pressure differential, temperature conditions and high voltage stress encountered in well bore operations.

2. Description of the Prior Art

The most pertinent prior art with which Applicant is familiar is U.S. Pat. No. 3,437,149. This patent discloses the use of an epoxy and an elastomer in an endeavor to secure and seal a multiple conductor cable in a barrier such as a wellhead. However, it is difficult to obtain and maintain a proper seal with a multiple conductor power cable merely by the use of epoxy and an elastomer. It is also difficult to field install, or to install, under all weather conditions. Where the conductors are subjected to a pressure differential across the barrier such as a wellhead, or a production packer in the well bore, such pressure tends to move the conductors relative to the barrier which causes additional problems.

FIELD OF THE INVENTION

In some instances, attempts have been made at solving the problem by threading armored or insulated electrical cable through the barrier and securing it by clamps and sealing or packing of the armored electrical cable against well pressure. However, the pressure differentials and the pressure existing in the well bore are such that the insulation was often damaged, cracked and conditions were created which sometimes cause rapid deterioration of the cable insulation covering. This in turn reduced the dielectic characteristics of the insulation so that the cable might be subject to overheating and a short circuit might occur between conductors which in turn might lead to burning and destruction of the cable itself. Additionally, the manner of clamping of the power cable in the barrier sometimes causes mechanical crushing of the cable insulation by the clamp means which may facilitate more rapid deterioration of the cable insulation.

The voltage encountered in well bore pump operations is relatively high, such as 2500 or more volts, which requires ample insulation to avoid degradation due to power load. The severe conditions of use, coupled with the power load, has caused frequent breakdown of the insulation and shorting of the cable or at the connections therein.

Additionally, where the installation is field installed, substantial field equipment and personnel are required, thus substantially increasing the cost. Even where prepackaged installations have been attempted, the above problems have not always been solved.

The present invention relates to an arrangement for enabling a multiple conductor power cable to be passed through a barrier, to be secured and sealed therewith against the well bore pressures and against pressure differentials in the well bore, and enables the multiple conductor terminations at each side of the barrier to be readily and easily connected with connectors of a suitable form, such as disclosed in my prior copending applications hereinabove referred to.

SUMMARY OF THE INVENTION

An object of the present invention is to segregate the individual conductors of a multiple conductor power cable, to enclose each of them in a steel tube so that they may be positioned in a barrier which barrier forms or which is provided with housing means in which securing means and sealing means are provided for engagng each multiple conductor to hold each conductor against movement longitudinally relative to the housing and to seal therewith. A member is movable longitudinally of the barrier or of the housing formed by the barrier to position and maintain the securing means which engages each conductor against movement longitudinally relative to the housing and to compress the packer to seal with each steel tube encased multiple conductor. The conductor ends terminate at different longitudinal relative positions on each side of the barrier for more readily enabling coupling means to be connected with the individual multiple conductors on each side of the barrier for connection with a power source and to equipment such as a pump in the well. This also reduces the cross-sectional area of the connections and increases the insulation thickness.

Other objects and advantages of the present invention will become more readily apparent from a consideration of the following description and drawing wherein:

DESCRIPTION OF THE PREFERRED EMBODIMENTS

Figure 1:
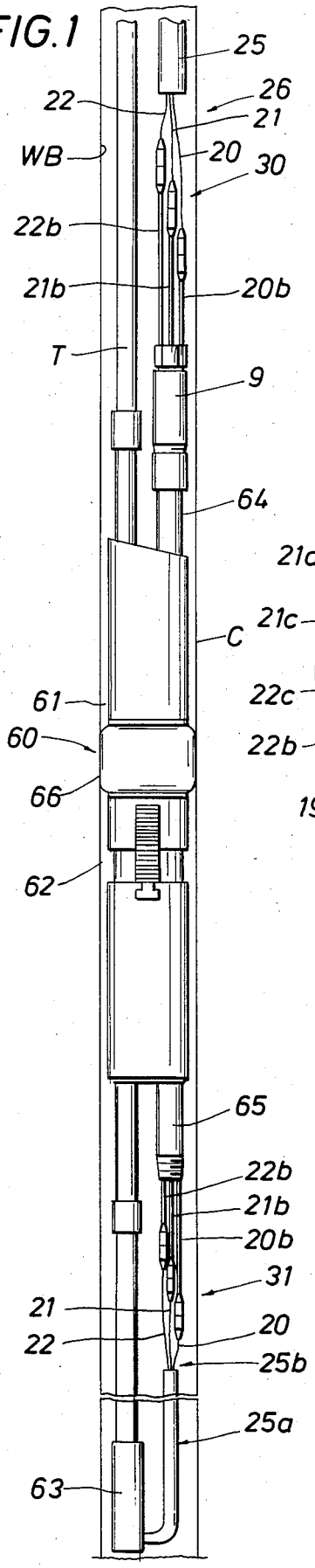
FIG. 1 is a vertical sectional view of a well bore illustrating a barrier in the form of a production packer therein with a production tubing extending therethrough and illustrating the penetrator and arrangement of the present invention for passing through the barrier.
Figure 3:
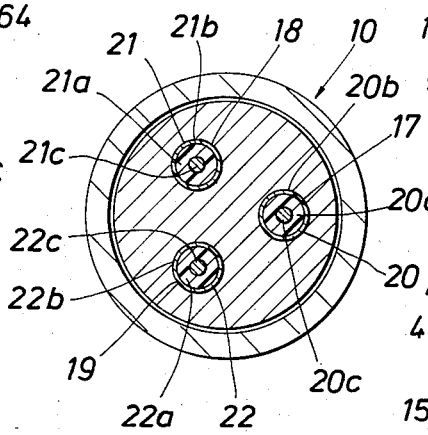
FIG. 3 is a sectional view on the line 3—3 of FIG. 2.
Figure 2:
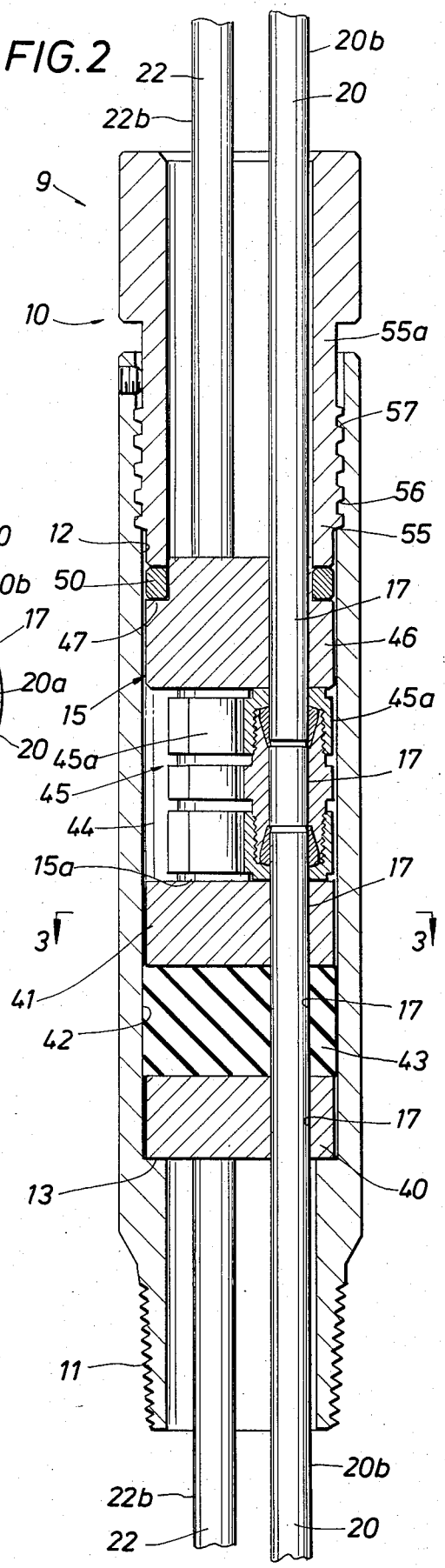
FIG. 2 is a vertical sectional view illustrating the preferred embodiment of the penetrator of the present invention for enabling a multiple conductor power cable to be passed through a barrier in a well bore.

Attention is first directed to FIG. 2 of the drawings wherein the penetrator of the present invention is referred to generally by the numeral 9. The penetrator includes a housing referred to generally by 10, which housing may be separately formed and provided with any suitable means such as the threads 11 thereon for engaging with the barrier, or the barrier itself may be formed to provide the housing for receiving the internal components forming the penetrator. The penetrator 9 includes an internal passage 12 extending longitudinally thereof which is provided with an annular shoulder 13 adjacent one end thereof. Support means referred to generally by the numeral 15 are provided in the passage 12, such support means having opening means as illustrated at 17, 18 and 19 therethrough for receiving the individual conductors, such as represented at 20, 21 and 22 of a multiple power cable 25 therethrough. As diagrammatically illustrated, generally by the numeral 26 in FIG. 1, the jacket and armor of the power cable 25 which surrounds the individual insulated electric conductors 20, 21 and 22 is removed therefrom to expose the individual insulated conductors for positioning in the penetrator 9 and for connection with coupling means referred to at 30 as will be described.

The support means 15 includes a member which may be referred to as the third thrust plate 40 seated on the shoulder 13 of the housing 10. It is longitudinally spaced from the member referred to as the second thrust plate 41 to provide a space 42 in the housing 10 for receiving a packer or seal means 43 between the thrust plates 40 and 41 as shown.

An additional member referred to as the first thrust plate 46 is longitudinally spaced from the second thrust plate 41 to provide a space 44 for receiving engaging means referred to generally at 45 between the first and second plates 46, 41. The conductors 20, 21 and 22 are each provided with suitable nonconducting insulation as illustrated at 20*a*, 21*a* and 22*a* and are each also provided with outer, tightly fitting rigid tubes, preferably stainless steel tubes 20*b*, 21*b* and 22*b*, respectively.

The stainless steel tubes 20*b*, 21*b* and 22*b* extend from the coupling means 30 on one side of the barrier (packer in FIG. 1) to the coupling means referred to at 31 on the other side of the barrier as shown in FIG. 1. The engaging means 45 comprises any suitable clamping or securing means such as swedge lock compression tube fittings illustrated at 45*a* in FIG. 2 of the drawings for engaging with each steel tube encased conductor 20, 21 and 22 as shown in FIG. 2. The engaging means clamps or grips each conductor to inhibit, or prevent, longitudinal movement of the conductors relative to the housing 10 as will be described. The conductors each include a core 20*c*, 21*c* and 22*c* of suitable conducting substance such as copper or the like. It can be appreciated that the insulation between the core and the steel tube may be formed of any suitable elastomer or plastic or any combination thereof as is well known to those skilled in the art.

The first, second and third thrust plates 46, 41 and 40 as well as the elastomer seal or packer body 43 are all provided with openings 17, 18 and 19 for receiving the electrical conductors therethrough, with each conductor extending through one longitudinal opening. It will be noted also that the openings in each of the thrust plates 40, 41 and 46 as well as the packer 43 are axially aligned so that the steel tubes are in turn axially aligned with the central axis of the barrier or housing through which they extend.

Bearing means 50 rest on the upwardly facing annular shoulder 47 formed on the first thrust plate 46 which may be of a different metal than the metal forming the thrust plate and which is also a different metal from the metal forming the positioning means 55 shown as a sleeve 55*a* and is movably engaged with the housing in any suitable manner, and as illustrated, it is threadedly engaged by the threads 56 on the outer surface of the sleeve 55*a* with the threads 57 in the housing passage 12. Rotation of the sleeve 55*a* relative to the housing 10 moves the sleeve 55*a* longitudinally against the thrust bearing 50 and due to the different coefficient of friction between the materials forming the positioning member 55 and bearing 50, the positioning member 55 may be freely rotated without rotating the bearing means 50 as well as the support plates or packer therebeneath. When the rotatable member 55 moves longitudinally to urge the plates 46, 41 and 40 longitudinally so that 40 is firmly seated on the shoulder 13, the plate 41 acts directly on packer or seal 43 to compress the packer or seal 43 to form a seal with each of the steel tubes or each of the conductors 20, 21 and 22 of the power cable 25. Also, the plate 46 abuts the top or one end 15 of the engaging means 45, while the plate 41 abuts the bottom or the other end 15*a* thereof to secure the clamps 45*a* of engaging means 45 and the multiple conductors of the power cable 25 against movement longitudinally relative to the housing 10, or relative to each other even under pressure differentials that may occur on each side of the barrier. Also, the steel tubes enable the elastomer packer 43 to seal individually with each of the conductors and to maintain an effective seal therewith the prevent leakage of fluid pressure due to the pressure differential into which the present invention may be subjected.

Since no rotation is imparted to the support means, twisting or entanglement of the conductors or distortion of the steel tubes upon rotation of the rotatable member 55 is prevented.

FIG. 1 demonstrates the present invention as it may be employed with a production packer 60 which forms a barrier in a well bore to separate the portion 61 of the well bore on one side of the packer 60, or barrier, from the portion 62 of the well bore on the other side of the packer 60, or barrier after the packer has been actuated in a manner well known in the art to seal with the casing C. A pump 63 is connected with the tubing beneath the packer 60 in the well bore portion 62 at a desired elevation. The production packer 60 as illustrated is a dual packer and provides one opening in which tubing T is connected and another opening extending therethrough to which is connected the extensions 64 and 65 as shown. The penetrator 9 of the present invention is connected at the upper extension 64 to communicate with the opening through the barrier as shown in FIG. 1.

Figure 4:
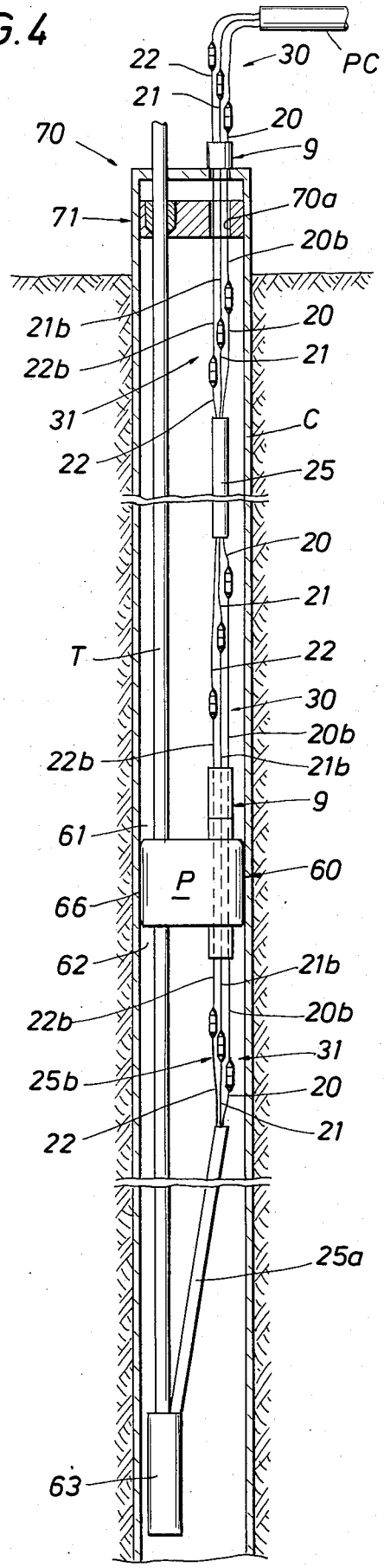
FIG. 4 is a schematic representation of a wellhead at the top of a well bore casing with a production tubing supported by the wellhead and extending through a production packer with a pump on the lower end thereof beneath the packer and diagrammatically illustrating the connection of a power cable through the barrier by the present invention with the pump on the lower end of the tubing.
Figure 5:
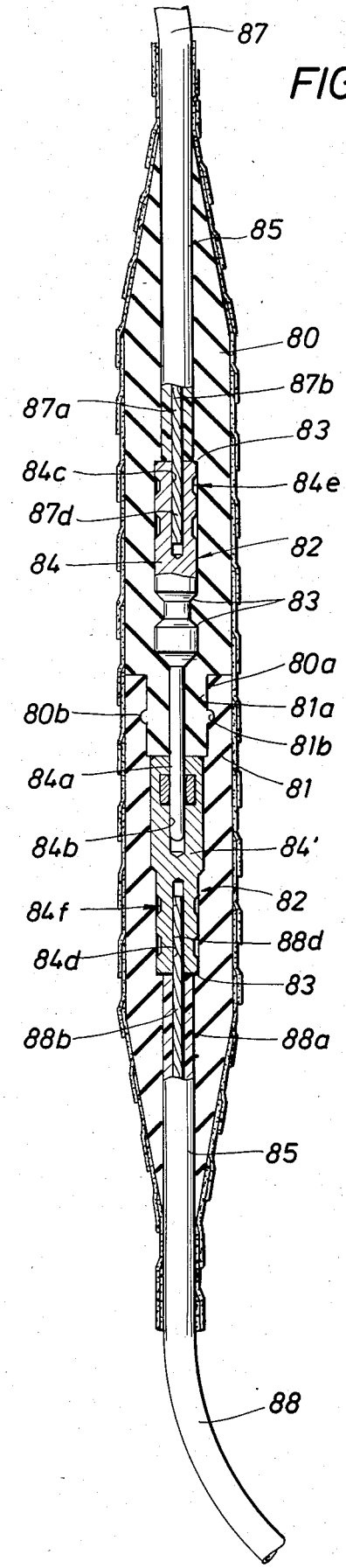
FIG. 5 illustrates a form of coupling means to connect the ends of the individual conductors.

In use of the present invention, the connections in the power cable from the earth's surface to the pump 63 are made before lowering the tubing T, packer 60 and pump 63 thereon into the well bore WB. The power cable lead 25*a* connected to the pump 63 extends upwardly therefrom when the assembly is positioned in the well bore WB as shown in FIG. 4. The jacket insulation and armor of a portion of this power cable lead 25*a* is removed to expose as illustrated at 25*b* the individual insulated conductors 20, 21 and 22 of the multiple conductor power cable for connection with the steel tube encased cables 20*b*, 21*b* and 22*b* extending below one side of packer 60 by the coupling means 31 such as disclosed and claimed in my prior copending applications hereinabove referred to. The steel tube encased portions 20*b*, 21*b* and 22*b* are extended through the opening in the packer 60 to project therefrom on the top or other side as shown at the upper end of FIGS. 1 and 4. It can be appreciated before lowering the tubing T with packer 60 into the well such steel tube encased conductors will have been first assembled in the penetrator 9 and it secured on packer 60 on tubing T at the earth's surface. The coupling means 31 as shown in FIG. 5 is then employed to connect the steel encased conductors beneath the packer P with the power cable lead 25*a* extending to the pump 63. Also, the member 55 will have been rotated to firmly secure and seal with each steel tube encased conductor so that it is held against movement longitudinally relative to the housing 10 and so that the seal 43 seals with each conductor. This also is accomplished at the earth's surface and then the steel encased conductors 20*b*, 21*b* and 22*b* which terminate at different longitudinal elevations above the packer 60 as shown in FIG. 1 may be joined with suitable connector means 30 shown in FIG. 5 and as disclosed in my copending applications with the exposed individual insulated conductors 20, 21 and 22 of power cable 25 extending from a power source on the earth's surface.

After connections in the power cable have been made at the wellhead as will be described with regard to FIG. 4, the tubing T with the pump 63 at the lower end thereof, the packer 60 and power cable 25 may be lowered into the well bore WB. The production packer 60 can be actuated in a manner well known to those skilled in the art to enable the packer to seal with the casing C in the well bore as illustrated at 66 to divide the well bore into two separate portions 61 and 62.

The power cable 25 also passes through a barrier at the earth's surface formed by the wellhead represented generally at 70 in FIG. 4. The wellhead apparatus includes a casing head or Braden head well known to those skilled in the art which supports hanger means represented at 71 by any suitable means well known to those skilled in the art which in turn supports the production tubing T therein and in position in the well bore as schematically illustrated in FIG. 4. The power cable must be supported, secured and sealed in the well head barrier in a manner similar to that described with the packer barrier of FIG. 4.

The hanger and wellhead have an opening 70*a* therethrough for receiving the steel encased conductors 20*b*, 21*b* and 22*b* supported in penetrator 9 on wellhead 70 as shown in FIG. 4. The steel encased conductors extend through the barrier formed by the wellhead 70 by means of penetrator 9 and they are connected by the connectors 30 to individual cables 20, 21 and 22 of the power cable PC above the wellhead at the earth's surface which power cable is for connection with a power source (not shown). The penetrator 9 secured with the opening 70*a* in the wellhead receives, supports, secures and seals with the multiple steel encased conductors of the power cable 25 extending downwardly from connections 30 in a manner as previously described herein. The conductors passing through penetrator 9 on the wellhead and through the hanger 71 are as noted steel encased tubes, and the power cable 25 below hanger 71 extending upwardly from connections 30 above packer P will be armored. However, the armor will again be removed to expose the individual insulated conductors 20, 21 and 22 for connection with the lower end of steel tube encased conductors 20*b*, 21*b* and 22*b* passing through the wellhead 70 by connection means 31 similar to that previously described and the upper end of steel tube encased conductors above the wellhead are connected by connections 30 to the exposed individual insulated conductors of the armored power cable as previously described with regard to the packer P as shown and described with regard to FIG. 1.

The exposed individual conductors 20, 21 and 22 at all the connections 30 and 31 may be provided with a protective shield and encapsulating body such as wrapping by suitable reinforced tape for protection before the arrangement is lowered into the well bore. The wrapping will extend from the connection formed by each connector or splice arrangement 30 or 31 along and around the individual insulated conductors to the armored part of the power cable. Where there are no fluids in the well bore which cause the insulation to swell, the wrapped shield may be eliminated.

It can be appreciated that the housing 10 provides a rigid shell for receiving the multiple conductors as well as the support, sealing and locking means which retain the conductors against longitudinal relative movement in the housing and which provide the seal therefor. Also, while the housing 10 is shown as being separate from the barrier and having suitable means such as the threads 11 for engaging with an opening that extends through the barrier, it can be appreciated that the barrier may provide or form the housing itself within the passage extending therethrough. When the housing 10 is separate from the barrier, but actually part thereof by being connected therewith, the housing 10 is positioned on the wellhead which includes support means for the tubing. The housing shell is provided with a seal and support arrangement for supporting and sealing each of the multiple conductors received through the shell and extending therefrom on opposite sides of the wellhead or supporting means. After the conductors, support and seal arrangement have been positioned in the housing, the seal and support arrangement is moved longitudinally thereof to secure the multiple conductors against the longitudinal movement relative to the shell and to seal off each of the conductors in the shell and the power cable may be connected with the multiple conductors for supplying power therethrough.

The coupling means for connections 30, 31 illustrated in FIG. 4 and is shown and claimed in my copending application Ser. No. 691,550 above referred to. Male and female boots 80, 81 are provided with a central passage 82 of different internal diameters to provide longitudinal spaced shoulders 83 therein. A male conducting copper contact pin 84 has surfaces to conform with the different internal diameters of passage 82 in the male boot 80 which retains it in place when the boot is positioned thereover. The female boot is likewise provided with a female copper socket 84' held in female boot by its conforming surfaces to passage 82 to thereby form mating stop and retaining shoulders.

The end passage portion 85 in each boot is of smaller internal diameter than the external diameter of the insulated conductor ends 87, 88 to form a sealing fit. The male pin has an end 84*a* fitting in passage 84*b* formed in which interfit is shown. Each conductor end 87, 88 has the insulation 87*a*, 88*a* removed to expose a noninsulated end 87*d*, 88*d* of copper conductor core 87*b*, 88*b* which are inserted in passage 84*c*, 84*d* of each the male pin of the male pin and female socket as shown. The adjacent portions 84*e*, 84*f* are then deformed by any suitable means to secure the core of each conductor 87, 88 with the male pin and female socket.

Seal surface 80*a*, 81*a* engage when the boots 80, 81 are interfitted and lock surfaces 80*b*, 81*b* engage. The internal diameter of surface 81*a* is smaller than the external diameter of surface 80*a* to form an interference fit therewith.

In assembly, the noninsulated ends 87*d*, 88*d* are each engaged in their respective pin and socket 84, 84' and the pin and socket crimped at 84*e*, 84*f*. Each boot 80, 81 is then pulled up over the pin 84 and socket 84', respectively, and insulation 87*a*, 88*a* of each conductor end 87, 88. The boots 80, 81 are positioned over the male pin 84 and female pin 84' with the aid of nonconducting lubricant and are then joined as shown. A protective and restraining encapsulating cover 90 in the form of reinforced tape may then wrapped around the boots 80, 81 and adjacent conductor ends. The tape is any well known type that is inert in hydrocarbons and reinforced with glass, metal or fibers which are also inert to hydrocarbons. This prevents the elastomer from swelling in the presence of gases and utilizes the suppressed swelling to form a tighter sealed connection. The compression enables the gas to seep out when the well is pumped down, or when the connection is removed from the well to thereby avoid disintegration due to a rapid attempt at gas exit from the elastomer boots. It may comprise metal telescoped encapsulatng tubes which are first placed on the conductor ends before the boots and then pulled down in position over the mated boots.

The penetrator arrangement and method of the present invention is relatively simple and eliminates the problem of trying to maintain a seal with epoxy and trying to perform an apparatus employing epoxy or employing epoxy in the field to overcome the problems of the prior art.

The foregoing disclosure and description of the invention are illustrative and explanatory thereof, and various changes in the size, shape and materials as well as in the details of the illustrated construction may be made without departing from the spirit of the invention.

I claim:

1. In a wellhead apparatus including a wellhead, the combination of:

hanger means supported on the wellhead;

means in said hanger for supporting a production tubing with an electric pump thereon in the well;

said hanger and wellhead having an opening for multiple conductor power cable to extend to the pump in the well;

housing means for connecting with the opening in the wellhead;

support means in said housing having a plurality of openings for receiving in each opening an individual conductor of the multiple conductor power cable;

said support means including:

engaging means in said housing means for engaging the individual conductors to restrain them against longitudinal movement relative to said housing means;

seal means in said housing for sealingly engaging with the individual conductors; and positioning means movable relative to said housing means to secure said engaging means against longitudinal movement relative to said housing means and to compress said seal means into sealing engagement with each of the multiple conductors.

2. The wellhead apparatus of claim 1 wherein each individual conductor of a multiple conductor power cable is covered by a rigid tube which extends continuously between said coupling means and through said hanger and said housing means.

3. The wellhead apparatus of claim 1 including individual conductor coupling means at opposite ends of said housing means below said hanger means and above said support and seal means whereby said housing means may be assembled with said hanger means and the pump power cable connected by said coupling means to the individual conductors for supplying power to the pump.

4. In a method of installing an electric power cable having multiple conductors in a wellhead arrangement including supporting means for tubing and an electrical feed through arrangement, the steps of:

positioning on the supporting means a rigid housing shell which has a seal and support arrangement for supporting and sealing each of the multiple conductors received through the rigid shell and extending therefrom on opposite sides of the support arrangement;

moving the seal and support arrangement longitudinally of the rigid shell to secure the multiple conductors against longitudinal movement relative to the rigid shell and seal each of the conductors in the shell; and connecting the electric power cable with the multiple conductors extending from each side of the support means.

5. A well bore barrier penetrator to seal with and hold against movement multiple conductors of a high voltage power cable passing through an opening in the barrier, comprising:

housing means for connecting with the barrier opening and having a longitudinal passage therethrough;

support means in said housing passage, said support means having passage means therethrough for receiving the individual conductors of a multiple conductor power cable therethrough; and said support means including:

engaging means in said housing means for engaging the individual conductors to restrain them against longitudinal movement relative to said housing means;

seal means in said housing for sealingly engaging with the individual conductors; and positioning means to secure said support means in said housing passage and said seal means in engagement with the multiple conductors.

6. The penetrator of claim 5 wherein said positioning means abuts said engaging means in said housing passage to retain the multiple conductors against longitudinal movement relative to said housing means and to urge said seal means into sealing position with the multiple conductors.

7. The penetrator of claim 6 wherein said retaining means includes a rotatable member rotatably engaged in said housing and wherein said support means includes bearing means to inhibit rotation of the multiple conductors in said housing means when said rotatable member is rotated to maintain said seal means in sealing engagement with the multiple conductors and to maintain the conductors against longitudinal movement relative to said housing means.

8. The penetrator of claim 7 wherein the passage means in said engaging means and seal means is axially aligned in said housing means to maintain each of the multiple conductors axis aligned with said housing means axis.

9. The penetrator of claim 5 wherein said passage means in said support means comprises a plurality of passages for providing a passage for each conductor of the multiple conductor power cable and wherein said engaging means includes an engaging element for each conductor of the multiple conductor power cable.

10. The penetrator of claim 5 wherein said support means includes:

bearing means between said support means and positioning means;

first thrust plate means having passages therethrough for each of the conductors and abutting said bearing means;

said engaging means including clapping elements for gripping each of the conductors and having one end abutting said first thrust plate means;

second thrust plate means having passages therethrough for each of the conductors and abutting the other end of said clamping elements to position said clamping elements and individual conductors gripped thereby against movement longitudinally of said housing means;

said seal means comprising an elastomer body having passages therethrough for receiving each of the conductors;

third thrust plate means spaced from said second thrust plate means for receiving said seal means therebetween;

said housing passage having a shoulder therein for seating said third plate means thereon; and said positioning means including a member rotatably engaged with said housing means for abutting said bearing means to urge said thrust plate means and seal means toward said shoulder means to hold said engaging means and conductors against longitudinal movement and to urge said seal means into sealing relation with each multiple conductor.

11. A barrier multiple conductor high voltage power cable arrangement for holding and sealing each multiple conductor as it passes through the barrier including:

a plurality of insulated conductors each having an outer rigid tube over the insulated conductor for extending through the barrier;

the barrier providing housing means through which the conductors with the rigid tubes extend;

means in said housing to clamp each rigid tube and hold the conductor against movement relative to the barrier;

packer means in said housing to surround and seal with the rigid tube of each conductor; and means to hold said clamps against movement relative to the barrier and to compress said packer means into sealing engagement with each rigid tube.

12. The invention of claim 11 wherein said conductors extend beyond the barrier on each side thereof.

13. The invention of claim 12 wherein each conductor terminates in longitudinal spaced relation to other conductors on each respective side of the barrier.

14. The invention of claim 13 including means to connect each conductor at its termination on one side of the barrier with a power cable from a power source and each of the conductors at its termination on the other side of the barrier with a pump.

15. A well bore barrier penetrator arrangement wherein each conductor of a multiple conductor high voltage power cable is seperately engaged to secure and seal it in position in an opening through the barrier, comprising:

seperate rigid tube means enclosing each conductor;

means to seperately clamp each seperate tube means with the barrier and separately hold each tube means against movement relative to the barrier; and means to seal each tube means with the barrier.

* * * * *